United States Patent [19]

Bowler

[11] 4,196,702

[45] Apr. 8, 1980

[54] SHORT DURATION FUEL PULSE ACCUMULATOR FOR ENGINE FUEL INJECTION

[75] Inventor: Lauren L. Bowler, Bloomfield Hills, Mich.

[73] Assignee: General Motors Corporation, Detroit, Mich.

[21] Appl. No.: 934,410

[22] Filed: Aug. 17, 1978

[51] Int. Cl.[2] ..... F02B 5/00

[52] U.S. Cl. ..... 123/32 EB; 123/32 EA; 123/32 EL

[58] Field of Search ..... 123/32 EB, 32 EA, 32 EL, 123/32 EH, 198 DB, 97 B

[56] References Cited

U.S. PATENT DOCUMENTS

| | | | |
|---|---|---|---|
| 3,620,196 | 11/1971 | Wessel | 123/32 EA |
| 3,623,461 | 11/1971 | Rabus | 123/32 EA |
| 4,002,152 | 1/1977 | Hoshi | 123/32 EA |
| 4,031,866 | 6/1977 | Asano | 123/32 EL |
| 4,084,552 | 4/1978 | Drews et al. | 123/32 EA |
| 4,094,274 | 6/1978 | Harada et al. | 123/32 EL |

*Primary Examiner*—Charles J. Myhre
*Assistant Examiner*—P. S. Lall
*Attorney, Agent, or Firm*—Robert M. Sigler

[57] ABSTRACT

In a pulse width modulated, fuel injected internal combustion engine having at least one injector characterized by transient fuel flow associated with injector opening and closing which tends to decrease the accuracy of the amount of injected fuel for short pulse durations, apparatus and method are provided for increasing the accuracy of injected fuel amount at low engine fuel requirements. When the normal determined pulse duration is less than a predetermined minimum pulse duration, the normal energization of the fuel injector is prevented and a number representing said determined pulse duration is summed in an accumulator. When the accumulator sum reaches the predetermined minimum pulse duration, the injector is energized for a duration at least equal to the predetermined minimum duration and the accumulator sum is reduced by a number corresponding to said duration.

6 Claims, 5 Drawing Figures

SHORT DURATION FUEL PULSE ACCUMULATOR FOR ENGINE FUEL INJECTION

BACKGROUND OF THE INVENTION

This invention relates to engine fuel injection systems, and particularly to those of the type in which an electromagnetic fuel injector having an open condition and a closed condition controls the flow of fuel from a constant pressure source.

In one form of such a fuel injection system, apparatus is provided to generate fuel injection pulses having durations determined according to the fuel requirements of the engine. Most commonly the injection pulses are timed synchronously with crankshaft rotation, although asynchronous timing is also known. The apparatus is further effective to apply the fuel injection pulses to the fuel injector to activate it to its open position for the durations of the pulses and to close it between the pulses. Since the flow of fuel through the injector is essentially constant once stable flow is established in the injector's fully open position, the durations of said pulses substantially control the time rate of fuel flow to the engine.

At the beginning and end of each of the fuel injection pulses, however, while the injector is opening and closing and the fuel flow is in a transient condition, the fuel flow rate through the injector varies from the fuel flow per unit time when the injector is fully open. Thus, a portion of the pulse is characterized by a variable flow rate other than the constant rate. When the fuel injection pulses are relatively long in duration, this introduces little inaccuracy in relation to the total fuel flow rate. However, at low engine speeds and loads, when the time rate of fuel flow is small and the fuel injection pulses thus must be comparatively short, the inaccuracy is a greater fraction of total fuel flow.

It is, therefore, useful to define a minimum injection pulse duration, below which an undesirable degree of inaccuracy is introduced into the fuel flow rate. For a particular engine, if such a minimum desired fuel injection pulse duration exists and if the corresponding fuel flow is greater than a fuel flow rate expected in the normal course of operating such an engine, such as during engine overrun or coast down conditions, it is desirable to provide some means to eliminate this inaccuracy or at least minimize its effect on engine operation.

SUMMARY OF THE INVENTION

It is an object of this invention to provide an improved method and apparatus for controlling pulse duration modulated fuel injector apparatus for an internal combustion engine wherein accuracy is improved at low engine fuel requirements, particularly during engine idle or overrun conditions which otherwise may require injector pulses too short for effective fuel metering.

It is a further object of this invention to provide an improved pulse duration modulated fuel injection method and system wherein fuel injectors are not energized for pulses of less than a predetermined minimum duration, but the fuel corresponding to such short duration pulses is injected at the earliest practical time after its requirement is determined.

It is yet another object of this invention to provide an accurate, improved, pulse modulated fuel injection apparatus and method adapted for use in an internal combustion engine in which the fuel injection may be performed in a throttle body from which a fuel/air mixture flows through an intake manifold for distribution to engine combustion chambers.

It is still another object of this invention to provide an improved pulse duration modulated fuel injection system having a first mode of operation wherein regularly spaced fuel pulses are delivered and a second mode of operation, for small engine fuel requirements, wherein fuel pulses are delivered irregularly, with engine fuel requirements nevertheless being accurately supplied, the engine fuel requirements being updated regularly on a constant time basis for quick response to a sudden increase in said engine fuel requirements and change from said second mode to said first mode.

In fulfillment of these objects, this invention provides, in its most general form, for an internal combustion engine having injector means normally energized by pulses having durations determined from engine fuel requirements but not so energized when the determined pulse duration is less than a predetermined minimum duration. Numbers representing said pulse durations not used to energize the injectors are accumulated in sum until the sum is at least equal to the predetermined minimum duration, at which time the injector apparatus is energized for a duration at least equal to the minimum predetermined duration and a number representing said duration is subtracted from the accumulator sum. Thus, when the determined durations of fuel injection pulses become shorter than a predetermined desired minimum, such pulses are held and summed until they can be delivered. The amount delivered in one embodiment of the invention may be the entire accumulated sum, in which case the accumulator is cleared. The normal energizations of the injector apparatus may be synchronous or asynchronous with engine rotation, although the accumulator summing of pulse duration numbers and energization of the injector apparatus on the basis of said accumulator sum is preferably done on an asynchronous, constant frequency basis.

Further details and objects of this invention will be apparent from the accompanying drawings and following description of a preferred embodiment.

DESCRIPTION OF THE PREFERRED EMBODIMENT

Figure 1:
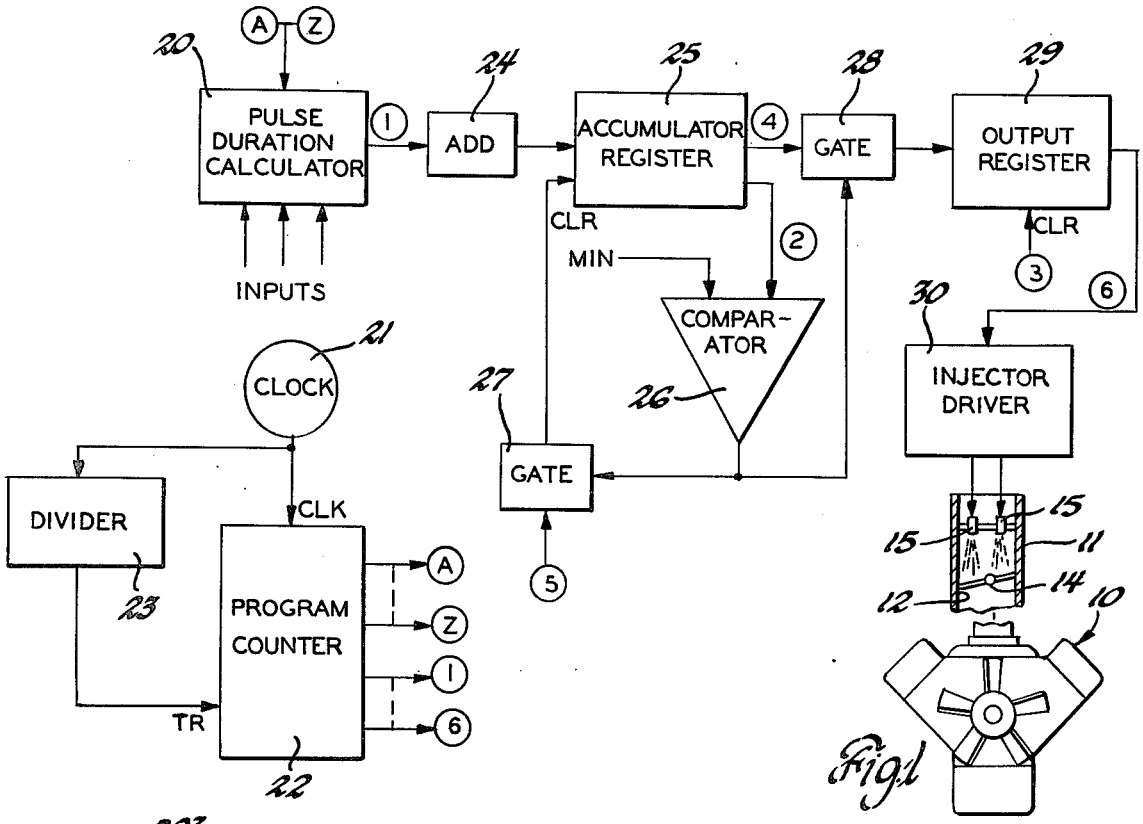
FIG. 1 is a schematic and block diagram of a first embodiment of this invention.

Referring to FIG. 1, an internal combustion engine 10 has an induction manifold 11 defining an induction passage 12 suitable for the induction of air into combustion chambers. Induction passage 12 typically contains a throttle valve 14 to control the flow of air therethrough and is provided in this embodiment with a pair of injectors 15 effective, when energized, to inject fuel from a standard pressurized fuel source, not shown, into induction passage 12. There may actually be two parallel induction passages 12, each with a throttle 14 and one of the injectors 15, each passage 12 feeding half the engine cylinders.

Injectors 15 are of the electromechanically actuated type which are normally closed and can be opened to a full open position by means of an energizing electric current through an actuating coil. While open, injectors 15 present a substantially constant predetermined orifice area which determines a fuel flow rate when fuel is supplied at a constant pressure. Fuel injectors 15 may be opened for regularly times pulses, in which case the amount of fuel delivered is substantially determined by the pulse duration. However, the opening and closing of fuel injectors 15 introduces transient conditions in which many factors change and fuel flow is generally not constant or entirely predictable. When pulse duration is long compared with these transient times, the inaccuracy introduced by said times is proportionately small. However, as pulse duration becomes shorter, the proportion of inaccuracy grows until a point may be reached at which it becomes unacceptable for the particular application.

A pulse duration calculator 20 is provided to calculate fuel injector pulse duration in response to one or more inputs on the basis of an internally stored table or algorithm. Many such pulse duration calculators are known in the prior art and it is, therefore, unnecessary to present details of its operation at this point. However, one type of pulse duration calculator well suited to operation in this embodiment is a digital computer programmed to calculate engine fuel requirements on the well known speed-density model, in which engine speed and manifold absolute pressure are two input variables and others such as temperature may be included.

Timing apparatus is provided for the pulse duration calculator 20, as well as the rest of this embodiment, in the form of a clock 21 which includes a source of real time pulses such as a quartz crystal controlled oscillator and supplies those pulses at a fast predetermined clock rate such as 100 KHz or 64 KHz to CLK input of a program counter 22 and further supplies the clock pulses to a divider 23. Divider 23 can be a standard counter which outputs a pulse for every N input pulses and thus supplies pulses at a significantly lower predetermined frequency to the trigger or TR input of a program counter 22.

Program counter 22, is basically a shift register which is effective, when triggered, to receive clock pulses and shift a digital one at the clock rate through a plurality of register bit positions, thus generating output pulses successively at the clock rate on a plurality of lines numbered A–Z and 1–6 in FIG. 1. Output lines A–Z, which may be any number of output lines, are reserved for the actuation of the component parts, in a predetermined order or program, of pulse duration calculator 20 in the embodiment of FIG. 1, so that the triggering of program counter 22 initially causes a pulse duration to be calculated by calculator 20. Output lines 1–6 are applied to other portions of the embodiment of FIG. 1 to be further described to cause the transfer of numbers between said portions. It can be seen that program counter 22, clock 21 and divider 23 are analogous to the standard timing circuitry of a digital computer device and may be so considered in this embodiment, which may preferably include such a digital computer specifically programmed with steps A–Z comprising a pulse duration subroutine and steps 1–6 comprising an output subroutine. However, the embodiment can also be constructed from discrete devices as shown.

The output of pulse duration calculator 20 is connected through an ADD apparatus 24 to the input of an accumulator register 25. Accumulator register 25 is a register effective to store a number entered therein until cleared and having further means by which the number may be read into or duplicated in some other register or device while still being retained in register 25. ADD apparatus 24 may be a digital adder or similar apparatus which is effective, when supplied a number from calculator 20, to add that number to the contents of accumulator register 25 and store the sum in accumulator register 25. Such devices as registers and adders are common parts of digital computer central processing units.

The output of accumulator register 25 is connected to one input of a digital comparator 26, the other input of which is provided with a constant reference MIN and the output of which is connected to control a gate 27 inserted in an input line to a clear or CLR input of accumulator register 25. Digital comparator 26 is a standard digital comparator which compares a first digital number to a second digital number and generates a digital 1 output if the first exceeds the second and a digital 0 output if the first does not exceed the second. Gate 27 may be any gate which may be activated to pass a number or signal therethrough or closed to prevent the passage of said number or signal therethrough by a control digital 1 or 0, such as would be obtained from the output of digital comparator 26. Gate 27 could thus comprise an AND gate having the output of digital comparator 26 as one of its inputs so that a digital 1 on the other input would result in a digital 1 on the output only if a digital 1 were also present on the output of digital comparator 26.

The output of comparator 26 also controls a gate 28 inserted between the output of accumulator 25 and the input of an output register 29. Output register 29 is another register similar to accumulator register 25 and capable of storing a digital number therein until cleared. Gate 28 might actually be a plurality of AND gates, each connected between two corresponding bit locations of accumulator register 25 and output register 29 and having one input connected to the output of digital comparator 26, so that the plurality of AND gates are opened or closed together. Comparators and gates are additional devices which have analogous circuitry in digital computer central processing units.

The output of output register 29 is connected to the input of injector driver 30. Injector driver 30 comprises a current source and switch means for controlling the application of current from said source to the electromagnetic actuating coils of injectors 15. Injector driver 30 further includes apparatus effective to obtain the number stored on output register 29 and timing means tied to clock 21 and effective to time the application of current to the injector actuating coils in accordance with said number. Many appropriate injector driver circuits are known in the prior art; and suitable interfacing apparatus between said driver circuit and the output register of a particular digital computer would be known or easily designed by someone familiar with said computer.

Output line 1 of program counter 22 is effective, when pulsed, to cause pulse duration calculator 20 to transfer the number representing the calculated pulse duration from an internal register through ADD apparatus 24 to be summed into accumulator register 25.

Output line 2 of program counter 22 is effective, when pulsed, to transfer the contents of accumulator register 25 to the input of comparator 26, which causes gates 27 and 28 to be opened when the contents of accumulator register 25 exceeds reference MIN and to be closed when the contents of accumulator register 25 does not exceed MIN. Output line 3 of program counter 22 is effective, when pulsed, to clear output register 29 at a clear input thereof; and output line 4 of program counter 22 is effective, when pulsed, to transfer the contents of accumulator register 25 through gate 28 to output register 29 only if gate 28 is open. Output line 5 of program counter 22 is connected through gate 27 to the CLR input of accumulator register 25 and is effective, when pulsed, to clear accumulator register 25 only if gate 27 is open. Finally, output line 6 of program counter 22 supplies a pulse to transfer the contents of output register 29 to injector driver 30 and initiate energization of injectors 15 if the number in output register 29 is not zero.

Therefore, in operation, after a pulse duration is calculated in calculator 20 according to the fuel requirements of engine 10, it is added to the contents already in accumulator register 25, which contents would ordinarily be zero if injector 15 had been energized on the previous computer cycle. If injectors 15 had not been energized on the previous computer cycle, the contents of accumulator 25 would not be zero and would be increased by the new pulse duration calculated by calculator 20.

The sum on the accumulator register 25 is compared with reference MIN, which represents a minimum desired pulse duration for the energization of injectors 15. If the sum is not greater than this reference, the output register 29 is cleared so that injectors 15 will not be energized on this computer cycle; and the sum on the accumulator register 25 is retained until the next computer cycle, to be increased by a new computed pulse duration and compared again. If, however, the sum on the accumulator register 25 exceeds the reference minimum desired pulse duration, the number is entered in the output register 29 to control the energization of injectors 15, the accumulator register 25 is cleared and the injectors 15 are energized.

It may occur, in some embodiment, that the entire contents of accumulator register 25 will not be transferred to output register 29. In this case, some predetermined number less than the number on accumulator register but at least equal to the reference MIN will be transferred to output register 29 if gate 28 is open. Therefore, the accumulator register 25 will not be cleared, since this would represent a loss of some fuel that has been determined to be required by the engine 10. Instead, the number on accumulator register 25 would be decreased only by an amount equal to the number transferred to output register 29.

Figure 4:
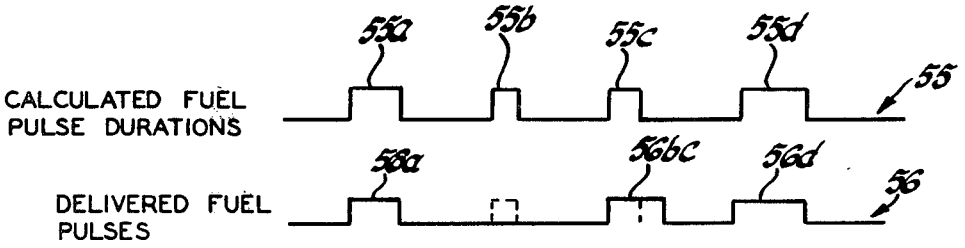
FIG. 4 is a timing diagram illustrating the operation of the embodiment of FIG. 1.

The operation of the system of FIG. 1 is illustrated in the timing diagrams of FIG. 4. Wave form 55 shows, on a time basis, the calculated fuel pulse durations computed on a constant frequency basis by pulse duration calculator 20. Each of pulses 55*a* through 55*d* has a duration which corresponds to an amount of fuel required by engine 10. However, pulses 55*b* and 55*c* are shorter than the predetermined minimum duration. Therefore, as shown in wave form 56, which shows the actual energizations of injectors 15, the injectors 15 are not energized for pulse 55*b*, however, they are energized in a pulse 56*bc* at the time of pulse 55*c*, where the total duration of pulse 56*bc* equals the combined durations of pulses 55*b* and 55*c* and is greater than the predetermined minimum duration. Pulses 56*a* and 56*d* are delivered at the normal times.

Figure 2:
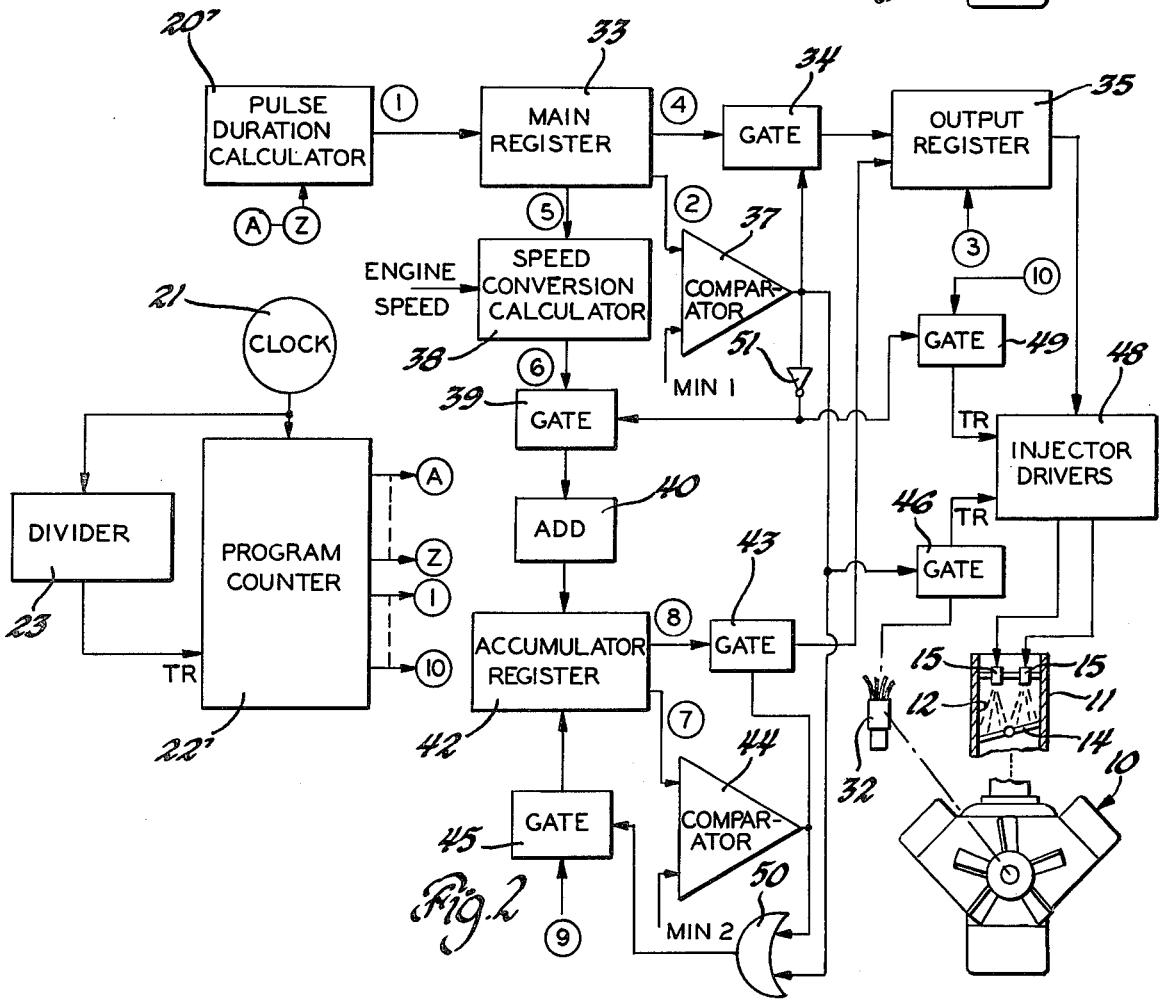
FIG. 2 is a schematic and block diagram of a second embodiment of this invention.

Another embodiment of this invention is shown in FIG. 2. Engine 10, throttle bore 11, induction passage 12, throttle 14, injectors 15, clock 21 and divider 23 may be identical with those correspondingly numbered in FIG. 1; and program counter 22′ may be identical with program counter 22 in FIG. 1 with the exception of several additional output lines. Engine 10 further includes a distributor apparatus 32, since this embodiment delivers many pulses of fuel from injectors 15 synchronously with engine rotation and distributor apparatus 32 provides rotation-indicating reference pulses suitable for triggering such synchronous injections. Pulse duration calculator 20′ may be similar to calculator 20 but compute pulse durations according to a somewhat different formula or algorithm.

The output of pulse duration calculator 20′ in FIG. 2 is connected to a main register 33 which is, in turn, connected through a gate 34 to an output register 35. Main register 33 is also connected to one input of a comparator 37 having another input supplied with a constant reference MIN 1, which represents a first predetermined minumum injection pulse duration. Main register 33 is finally connected to a speed conversion calculator 38 which is, in turn, connected through a gate 39 and ADD apparatus 40 to an accumulator register 42.

Accumulator register 42 is connected through a gate 43 to output register 35 and further connected to one input of a comparator 44 having another input supplied with a constant reference MIN 2, which represents a second predetermined minimum pulse duration. An input line to the clear or CLR input of accumulator register 42 is controlled by a gate 45. A gate 46 controls the application of pulses from distributor apparatus 32 to the trigger or TR input of injector drivers 48; and another line to the TR input of injector drivers 48 is controlled by a gate 49. The output of comparator 37 is provided to control gate 34, gate 46 and, through an OR gate 50, gate 45. The output of comparator 37 further controls, through an inverter 51, gate 39 and gate 49. All these devices are either included or analogous to circuitry included in the central processing unit of a digital computer.

Output lines A–Z of program counter 22′ control pulse duration calculator 20′ as in the embodiment of FIG. 1. A pulse on output line 1 of program counter 22′ is effective to transfer a number representing the calculated pulse duration from calculator 20′ to main register 33. A pulse on output line 2 of program counter 22′ is effective to transfer the contents of main register 33 to comparator 37, wherein it is compared with MIN 1. If the number is greater than MIN 1, comparator 37 causes the opening of gates 34, 46 and 45 and the closing of gates 39 and 49. If the number does not exceed MIN 1, comparator 37 causes the closing of gates 34, 46 and 45 and the opening of gates 39 and 49. Output line 3 of program counter 22′ is connected to the clear or CLR input of output register 35; and a pulse on that line is therefore effective to clear that register. An output pulse on line 4 of program counter 22′ is effective to transfer the contents of main register 33, if gate 34 is open, to output register 35.

In the operation of the system as described to this point, as long as the calculated pulse durations are greater than the minimum duration determined by the number MIN 1, each successive calculated duration will be entered in turn in output register 35 so there is always one such number available for the injector drivers 48. In addition, gate 49 will be closed and gate 46 open so that trigger pulses will be supplied on a synchronous basis from distributor apparatus 32 to injector drivers 48, which drivers, when triggered, fetch the number on output register 35 and initiate energization of injectors 15 for a duration determined by said number. The speed of the engine, and therefore the rate of synchronous energizations of injectors 15 may vary; however, the rate of updating a pulse duration in output register 35 proceeds at the computer clock rate. Such operation is well known in computer controlled systems through the use of interrupt signals which stop the main program, activate a subroutine and then return to the main program.

An output pulse on line 5 of program counter 22' is effective to transfer the contents of main register 33 to speed conversion calculator 38. Speed conversion calculator 38 has an input from a standard engine speed monitoring means, not shown, which may derive engine speed from the pulses from distributor apparatus 32. The purpose of speed conversion calculator 38 is to convert the number computed by pulse duration calculator 20' on the basis of fuel per cylinder for use in a synchronous injection system to another number corrected by an engine speed factor to units of fuel per constant frequency injection.

An output pulse on line 6 of program counter 22' is effective to transfer the number from speed conversion calculator 38 through ADD apparatus 40 if gate 39 is open, to accumulator register 42, whereby the number is summed with the previous contents of accumulator register 42 and the sum is stored in that register. A pulse on output line 7 of program counter 22' is effective to transfer the contents of accumulator register 42 to one input of comparator 44, where it is compared with the number MIN 2. If the contents of accumulator register 42 exceeds MIN 2, gates 43 and 45 will be open; and if it does not, gates 43 and 45 will be closed.

A pulse on output line 8 of program counter 22' is effective to transfer the contents of accumulator register 42, if gate 43 is open, to output register 35. Output line 9 of program counter 22' is connected through gate 45 to the clear or CLR input of accumulator register 42; and a pulse thereon is effective, when gate 45 is open, to clear the accumulator register 42 to zero. Finally, a pulse on output line 10 of program counter 22' is effective, when gate 49 is open, to trigger injector drivers 48 to initiate energization of injectors 15 for a duration determined by the number stored currently in output register 35.

Therefore, when the calculated pulse duration from calculator 20' does not exceed the reference MIN 1, as determined by comparator 37, gates 46 and 49 are reversed to end synchronous injection and transfer injection control completely to computer time based apparatus. In addition, no energization of injectors 15 takes place in this mode of operation until the computer cycle in which the sum on accumulator register 42 exceeds reference MIN 2, at which time the number on accumulator register 42 is transferred to output register 35, accumulator register 42 is cleared, and the injectors 15 are energized for a duration controlled by the accumulated sum. Of course, the variation described in the embodiment of FIG. 1 in which less than the total number on the accumulator register is transferred to the output register, is also possible with this embodiment.

In some embodiments MIN 1 and MIN 2 might be equal, but in the embodiment reduced to practice, they were set at 1.2 and 1.5 milliseconds, respectively. This was due to the characteristics of the injectors used, which began to lose their linearity below 1.5 milliseconds but did not depart too radically from linearity for pulse durations somewhat below that figure. The minimum duration for switchover to the asynchronous, pulse accumulating mode was set at 1.2 milliseconds in an attempt to restrict such operation to engine overrun conditions. Once in that mode, however, a full 1.5 millisecond pulse was required for delivery.

Figure 5:
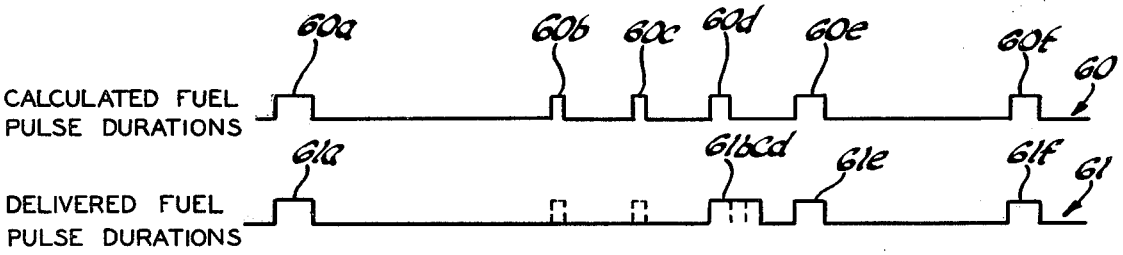
FIG. 5 shows a timing diagram illustrating the operation of the embodiment of FIG. 2.

The operation of the embodiment of FIG. 2 can be illustrated with reference to the wave forms 60 and 61 of FIG. 5. The calculated fuel pulse durations are shown in wave form 60 on a time basis. It should be noted in connection with wave form 60 that the actual computer calculations are carried out on a constant frequency basis by the computer; however, wave form 60 shows when the pulses would be delivered in the absence of a predetermined minimum pulse duration. The actual delivered fuel pulse durations are shown in wave form 61.

Since pulse **60*a* exceeds the predetermined minimum, it is delivered as pulse 61*a* in synchronism with engine rotation, which, in this embodiment, corresponds to a slow engine speed. The calculated pulse width of pulse 60*b*, intended to be delivered on a synchronous basis, is shorter than the predetermined minimum and therefore no such pulse is delivered. In addition, the system switches to asynchronous, computer based operation and the next pulse 60*c* would be delivered, if the sum of it and pulse 60*b* exceeded the minimum, at a time sooner than would be the case if synchronous operation still prevailed. However, in this embodiment, the sum of 60*b* and 60*c* still is shorter than the predetermined minimum; and it requires another calculated pulse 60*d* before pulse 61*bcd* is delivered with a duration equal to the sum of pulses 60*b*, 60*c* and 60*d*. Pulse 60*e* is greater than the predetermined minimum and results in the delivered pulse 61*e* and a return to synchronous operation, which is continued with pulses 60*f* and 61*f***.

It can be seen that pulse **61*bcd***, in this embodiment, was still delivered at a time sooner than would have been the case had the system been able to deliver fuel pulses only at normal synchronous times. This results in better fuel delivery to the air for which it is calculated and illustrates one of the advantages of switching to asynchronous operation during low speed, low fuel requirement conditions.

In practice, the cycle time of program counter 22', as determined by clock 21 and divider 23, may be set at approximately 10 milliseconds. If the normally synchronous injection of the embodiment of FIG. 2 is set to energize injectors 15 alternately, once per cylinder, the pulse rate for each injector 15 in the synchronous mode will vary from approximately once every 10 milliseconds at high speed to once every 50 milliseconds at idle. Since the accumulation of pulse duration is most desirable during engine overrun when engine speed is generally slowing, the shift to asynchronous operation with a cycle time of 10 milliseconds is advantageous in that it will generally result in the delivery of fuel more often at the lower speeds than would be the case if synchronous operation were continued. This will result in a smoother and more accurate fuel flow to the engine.

Another advantage of shifting to asynchronous constant frequency operation while injection pulse durations are being accumulated is based on the need for immediate response to an increase in manifold absolute pressure. In the speed density model of computing engine fuel requirement, engine airflow is not measured directly but is calculated from the measured manifold absolute pressure in the intake manifold, which is a variable, and a number of constant conversion factors which convert this pressure at the intake of a cylinder to a calculated airflow volume per cylinder. This can be converted by the desired air-fuel ratio into a required fuel per cylinder and the number corrected, if necessary, to a time basis by means of a measurement of engine speed or, in the synchronous mode, used on a per cylinder basis. However, when a sudden increase in manifold absolute pressure is registered, there is not only a larger airflow into the engine, but a larger amount, by weight, of air within the manifold itself, which accounts for the higher pressure. Additional fuel must be supplied to this air in a throttle body injection system if a desired air-fuel ratio is to be maintained; and this injection should be as soon as possible after the increase in manifold absolute pressure is detected. In a synchronous system at engine idle speed, the opportunity for increasing fuel flow occurs only once every 25 milliseconds or longer unless provision is made for special asynchronous pulses on a transient basis. The use of asynchronous, computer timed injection simplifies fuel delivery during the overrun or fuel pulse duration accumulating mode by eliminating the need for such special transient fuel delivery during that mode.

Figure 3:
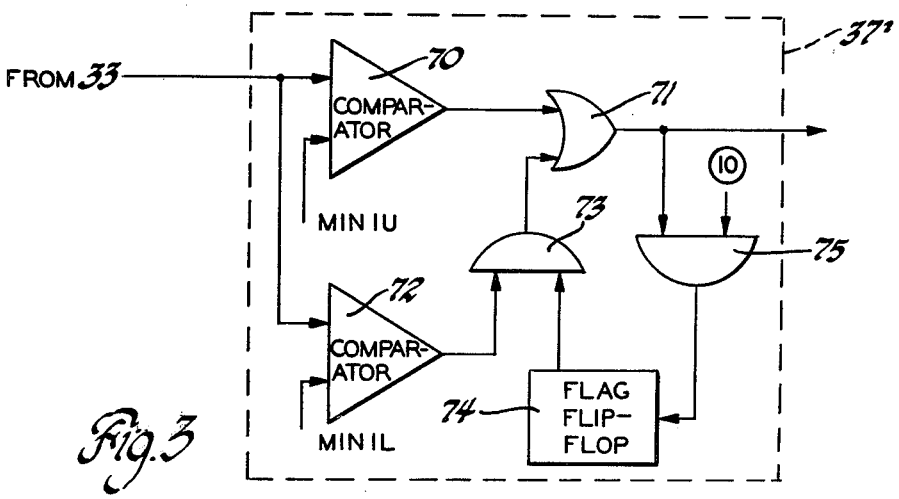
FIG. 3 is a block diagram showing a modified element for use in the embodiment of FIG. 2.

The embodiment of FIG. 2 may be stabilized against the possibility of oscillation between synchronous and asynchronous operation by the introduction of hysteresis in the switch-over, if this is found to be desirable. This may be accomplished by the modification shown in FIG. 3, which shows a replacement module 37' for comparator 37.

A comparator 70 has one input adapted to receive the contents of main register 33, which input corresponds to the one input of comparator 37 in the embodiment of FIG. 2 which is connected to main register 33. The other input of comparator 70 is provided with a reference MIN 1U and the output is provided to one input of an OR gate 71. Another digital computer 72 also receives the contents of main register 33 on one input and a constant reference MIN 1L on the other input. The output of comparator 72 is provided to one input of an AND gate 73 which has an output to the other input of OR gate 71. A flag flip-flop 74, which is a device well known in digital computers as a one bit memory or may be one bit of normal RAM space, is provided with an output to the other input of AND gate 73. The input of flag flip-flop 74 is received from the output of an AND gate 75 having one input from the output of OR gate 71, which output is also provided as the output from module 37' and corresponds to the output of comparator 37 in the embodiment of FIG. 2. Finally, the other input of AND gate 75 receives a strobe pulse from output line 10 of program counter 22' in the embodiment of FIG. 2.

In the operation of module 37', the pulse on output line 10 of program counter 22' at the end of each program cycle strobes the output of OR gate 71 into flag flip-flop 74, which is essentially a memory which remembers whether the fuel injection system was injecting synchronously or asynchronously in this just completed computer cycle. This information is then available during the next computer cycle and is used to select between two minimum pulse durations to provide hysteresis in the switch-over between synchronous and asynchronous operation. Reference MIN 1U is a greater number than reference MIN 1L, so that synchronous operation will be assured in this next program cycle if the contents of main register 33 exceeds the higher number MIN 1U or exceeds the lower number MIN 1L with the operation of the system in the previous computer cycle having been synchronous. However, the output of module 37' will provide for asynchronous operation if the contents of main register 33 are less than the lower reference MIN 1L or lower than the higher reference MIN 1L with system operation in the previous computer cycle having been asynchronous. This hysteresis provides for the switch-over between the firing of injectors 15 on a synchronous basis of injector per cylinder and the firing of injectors 15 on a constant frequency basis.

The embodiments described above are preferred, but others will occur to those skilled in the art. Therefore, this invention should be limited only by the claims which follow.

What is claimed is:

1. In combination:

an internal combustion engine having an induction passage;

injector means effective, when energized, to inject fuel into the induction passage in amount determined by the duration of said energization, the accuracy of said injected amount tending to decrease for shorter durations;

first means normally effective to energize the injector means in pulses having durations determined according to the fuel requirements of the engine;

second means responsive to the determined durations of said pulses to disable the first means and thereby prevent injector energization for pulses having durations less than a first predetermined minimum duration;

accumulator means effective, when the first means is disabled, to sum numbers representing the determined durations of those pulses for which the injector means is thus prevented from being energized;

third means effective, when the first means is disabled, to energize the injector means in a pulse having at least a second predetermined minimum duration, which may equal the first predetermined minimum duration, when the accumulator sum at least equals said second predetermined minimum duration; and fourth means effective, in response to actuation of the third means, to reduce the accumulator sum by a number representing the duration of the pulse initiated by the third means, whereby the accuracy of the amount of injected fuel is improved at low engine fuel requirements.

2. In combination:

an internal combustion engine having an induction passage;

fuel injector means effective, when energized, to inject fuel into the induction passage in amount determined by the duration of the energization, the fuel injector means characterized by decreasing accuracy in the injected amount for energizations of shorter duration;

first means normally effective to energize the injector means at regular predetermined times in pulses having durations determined according to the fuel requirements of the engine;

second means responsive to the determined duration of said pulses to disable the first means and thereby prevent energization of the injector means for pulses having durations less than a predetermined minimum duration;

accumulator means effective, when the first means is disabled, to sum numbers representing the determined durations of those pulses for which the injector means is not energized;

third means effective, when the first means is disabled, to energize the injector means in a pulse having a duration determined by the accumulator sum at the first regular predetermined time after the accumulator sum exceeds the predetermined minimum duration; and fourth means effective, in response to the third means, to clear the accumulator means, whereby the accuracy of the amount of injected fuel is improved at low fuel supply rates.

3. In combination:

an internal combustion engine having a crankshaft and an induction passage;

injector means effective, when energized, to inject fuel into the induction passage in amount determined by the duration of said energization, the accuracy of the injected amount tending to decrease at shorter durations;

first means normally effective to energize the injector means in pulses timed synchronously with crankshaft rotation, the pulses having durations determined according to engine fuel requirements;

second means responsive to the determined duration of said pulses to disable the first means and thereby prevent said synchronous energization for pulses having determined durations less than a first predetermined duration;

accumulator means effective, when the first means is disabled, to sum, on a constant time basis, numbers representing injection pulse durations determined according to engine fuel requirements;

third means effective, when the first means is disabled, to energize the injector means in a pulse having a duration equal to the accumulated sum when said accumulated sum exceeds a second predetermined minimum duration; and fourth means effective, in response to actuation of the third means, to clear the accumulated sum to zero, whereby the accuracy of fuel injection amount is improved at low engine fuel requirements.

4. Fuel control apparatus for an internal combustion engine having an induction passage and injector means effective, when energized, to inject fuel into the induction passage in amount determined by the duration of said energization, the accuracy of said injected amount tending to decrease at shorter durations, the apparatus comprising, in combination:

first means normally effective to energize the injector means at regular predetermined times in pulses having durations determined according to the fuel requirements of the engine;

second means responsive to the determined duration of said pulses to disable the first means and thereby prevent energization of the injector means for pulses having durations less than a predetermined minimum duration;

accumulator means effective, when the first means is disabled, to sum numbers representing the determined durations of those pulses for which the injector means is not energized;

third means effective, when the first means is disabled, to energize the injector means in a pulse having a duration determined by the accumulator sum at the first regular predetermined time after the accumulator sum exceeds the predetermined minimum duration; and fourth means effective, in response to the third means, to clear the accumulator means, whereby the accuracy of the amount of injected fuel is improved at low fuel supply rates.

5. Fuel injection control apparatus for an internal combustion engine having a crankshaft, an induction passage and injector means effective, when energized, to inject fuel into the induction passage in amount determined by the duration of said energization, the accuracy of the injected amount tending to decrease at shorter durations, the apparatus comprising, in combination:

first means normally effective to energize the injector means in pulses timed synchronously with crankshaft rotation, the pulses having durations determined according to engine fuel requirements;

second means responsive to the determined duration of the pulses to disable the first means and thereby prevent said synchronous energization for pulses having determined durations less than a first predetermined duration;

accumulator means effective, when the first means is disabled, to accumulate in sum, on a constant frequency basis, numbers representing injection pulse durations determined according to engine fuel requirements;

third means effective, when the first means is disabled, to energize the injector means in a pulse having a duration equal to the accumulated sum when said accumulated sum exceeds a second predetermined minimum duration; and fourth means effective, in response to actuation of the third means, to clear the accumulated sum to zero, whereby the accuracy of fuel injection amount is improved at low engine fuel requirements.

6. The method of injecting fuel into the induction passage of an internal combustion engine by means of injector apparatus which injects fuel in amount determined by the duration of energization and which is characterized by decreasing accuracy in injected amount for shorter durations of energization, the method comprising the steps:

normally energizing the injector apparatus at regular predetermined times in pulses having durations determined by the fuel requirements of the engine;

preventing energization of the injector apparatus for those pulses having determined durations less than a first predetermined minimum duration;

accumulating, in sum, numbers representing the determined durations of those pulses for which the injector means is thus prevented from being energized;

energizing the injector apparatus at the first regular predetermined time after the accumulated sum becomes at least equal to a second predetermined minimum duration, which may equal the first predetermined minimum duration, for an energization duration at least equal to the second predetermined minimum duration; and reducing the accumulated sum, when the injector apparatus is energized according to said immediately preceding step, by a number representing said energization duration, whereby fuel is injected into the engine induction passage accurately at low engine fuel requirements.

* * * * *